US008919458B2

(12) United States Patent
Plop

(10) Patent No.: US 8,919,458 B2
(45) Date of Patent: Dec. 30, 2014

(54) SYSTEM AND METHOD FOR DRILLING A DEVIATED WELLBORE

(75) Inventor: Andrei Plop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 531 days.

(21) Appl. No.: 13/186,986

(22) Filed: Jul. 20, 2011

(65) Prior Publication Data

US 2012/0037428 A1 Feb. 16, 2012

Related U.S. Application Data

(60) Provisional application No. 61/372,501, filed on Aug. 11, 2010.

(51) Int. Cl.
*E21B 7/04* (2006.01)
*E21B 7/06* (2006.01)

(52) U.S. Cl.
CPC ..... *E21B 7/067* (2013.01)
USPC ..... 175/61; 175/73; 175/78

(58) Field of Classification Search
USPC ..... 166/244.1; 175/77
See application file for complete search history.

(56) References Cited

U.S. PATENT DOCUMENTS

| | | | | |
|---|---|---|---|---|
| 4,492,276 | A * | 1/1985 | Kamp | 175/61 |
| 5,090,496 | A | 2/1992 | Walker | |
| 5,484,029 | A * | 1/1996 | Eddison | 175/73 |
| 5,979,570 | A * | 11/1999 | McLoughlin et al. | 175/24 |
| 6,092,610 | A * | 7/2000 | Kosmala et al. | 175/61 |
| 6,394,193 | B1 | 5/2002 | Askew | |
| 6,554,083 | B1 | 4/2003 | Kerstetter | |
| 6,571,888 | B2 | 6/2003 | Comeau et al. | |
| 7,234,543 | B2 * | 6/2007 | Schaaf | 175/61 |
| 7,243,739 | B2 | 7/2007 | Rankin, III | |
| RE39,970 | E | 1/2008 | Askew | |
| 7,481,281 | B2 * | 1/2009 | Schuaf | 175/61 |
| 2002/0175003 | A1 * | 11/2002 | Pisoni et al. | 175/74 |
| 2005/0236189 | A1 | 10/2005 | Rankin | |
| 2007/0151767 | A1 | 7/2007 | Downton | |
| 2008/0197732 | A1 | 8/2008 | Cioceanu | |
| 2009/0159339 | A1 | 6/2009 | Von Gynz-Rekowski et al. | |
| 2010/0018770 | A1 | 1/2010 | Moriarty et al. | |
| 2012/0145462 | A1 | 6/2012 | Leising et al. | |

* cited by examiner

*Primary Examiner* — Jennifer H Gay
*Assistant Examiner* — Caroline Butcher
(74) *Attorney, Agent, or Firm* — Kimberly Ballew

(57) ABSTRACT

A system and method for drilling a wellbore along a desired well path is disclosed. The system and method employed a bearing housing which may be connected into a bottom hole assembly to facilitate drilling of deviated wellbore sections. The bearing housing has an internal bore with an axis that can be positioned to form a non-zero angle with the central or longitudinal axis of the bearing housing. The internal bore is designed to rotatably receive a drill bit shaft such that a drill bit is oriented at a desired angle with respect to the bearing housing. Alternatively, the internal bore may be positioned in a sleeve which is received in the bearing housing.

20 Claims, 1 Drawing Sheet

SYSTEM AND METHOD FOR DRILLING A DEVIATED WELLBORE

CROSS REFERENCE TO RELATED APPLICATIONS

This application claims the benefit of U.S. Provisional Application No. 61/372,501 filed Aug. 11, 2011, the entirety of which in incorporated by reference.

BACKGROUND INFORMATION

Coiled tubing drilling applications use a "bent" mud motor below an orienter to enable directional steering of the coiled tubing. The orienter is required to adjust the tool face by adjusting the orientation of the bend to steer the bit as the bent mud motor slides along with the coiled tubing. Orienting the bend and steering the bit in this manner enables formation of the well path, and thus the wellbore, in a desired direction.

Some drilling assemblies use a continuously rotating orienter that spins the bent mud motor at slow speeds to neutralize directional effects caused by the bent mud motor, thus enabling drilling of a straight portion of the wellbore. Rotation of the bent mud motor assembly in a wellbore, however has detrimental effects that can shorten the life of the drilling assembly, e.g. bottom hole assembly. Additionally, the rotation causes friction between the bottom hole assembly and the wellbore which may lead to undesirable hole quality and diameter.

SUMMARY

In general, the present disclosure provides a system and methodology for drilling a wellbore. The system and methodology use a bearing housing that is connected into a drilling assembly, the bearing housing being designed to facilitate drilling of deviated wellbore sections. The bearing housing has an internal bore with an axis that can be positioned to form a non-zero angle with the central or longitudinal axis of the bearing housing. The internal bore is designed to rotatably receive a drill bit shaft such that a drill bit is oriented at a desired angle with respect to the bearing housing.

BRIEF DESCRIPTION OF THE DRAWINGS

Certain embodiments of the invention will hereafter be described with reference to the accompanying drawings, wherein like reference numerals denote like elements.

DETAILED DESCRIPTION

In the following description, numerous details are set forth to provide an understanding of the present disclosure. It will be understood by those of ordinary skill in the art that the present disclosure may be practiced without these details and that numerous variations or modifications from the described embodiments may be possible.

The present disclosure generally relates to a system and methodology which facilitate drilling operations. According to an embodiment, the system provides a drilling assembly designed to enhance the selective drilling of deviated wellbore sections. The system may reduce the bit-to-bend distance and may reduce the effective bend angle required to optimally steer the well path. The design enables straightening of the motor assembly consequently, bending stresses and vibrations also are reduced. The design may also facilitate continuous rotation of the power section and bit assembly when straight well paths are desired during formation of straight sections of the wellbore.

As described in greater detail below, an embodiment enables placement of a drive shaft and bit box at a non-zero angle with respect to a longitudinal axis of the outer housing, that may be referred to as the bearing housing. The design enables directional drilling without employing a "bend housing"; although certain embodiments may be designed with a combination of a bend housing and the non-zero/misaligned axis of the drill bit shaft bore relative to the longitudinal axis of the bearing housing. Without a bend or bent housing, the power section, e.g. mud motor, and the bearing housing each may be designed with a generally linear outer housing and a common longitudinal axis.

In another embodiment, the bearing housing comprises an internal sleeve positioned within a radially outer portion of the bearing housing. The internal sleeve comprises an internal bore sized to rotatably receive the drill bit shaft for rotation by the power section. The internal bore may be oriented at an offset angle through the internal sleeve such that the drill bit shaft is oriented at a non-zero angle with respect to the longitudinal axis of the bearing housing and the internal sleeve. In some embodiments, the internal sleeve may be adjusted to change the offset angle of the internal bore and thus of the drill bit shaft. For example, the sleeve may be rotatable within the radially outer portion of the bearing housing such that the angular orientation of the internal bore relative to the longitudinal axis of the bearing housing may be changed. The sleeve may be designed to enable alignment of the internal bore of the sleeve with the longitudinal axis for drilling straight well paths when forming straight sections of the wellbore.

Figure 1:
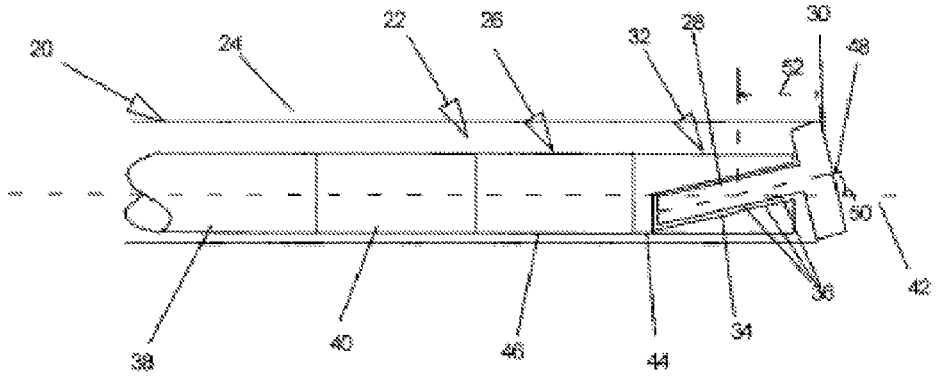
FIG. 1 is a schematic illustration of one example of a drilling assembly, e.g. bottom hole assembly, positioned in a wellbore and having a bearing housing, according to an embodiment of the present disclosure.

Referring generally to FIG. 1, a well system 20 is illustrated as having a drilling assembly 22 constructed to enable drilling of a deviated wellbore 24. In some embodiments, the drilling assembly 22 may be constructed as a bottom hole assembly. In the illustrated example, the drilling assembly 22 comprises a power section 26 designed to rotate a drill bit shaft 28 coupled to a drill bit 30. By way of example, the power section 26 may comprise a mud motor or other suitable motor operatively coupled with the drill bit shaft 28. The drilling assembly 22 further comprises a bearing housing 32 having an internal bore 34 that is sized to receive the drill bit shaft 28. The drill bit shaft 28 may be rotatably mounted within internal bore 34 via bearings 36 that secure the drill bit shaft 28 and facilitate long-term rotation of the drill bit shaft 28 and drill bit 30. By way of example, the bearings 36 comprise axial and radial bearings.

In the embodiment illustrated, the drilling assembly 22 is delivered downhole via coiled tubing 38. The coiled tubing 38 may be coupled to power section 26 or to another suitable component of drilling assembly 22 by an upper connector 40. In some applications, the entire drilling assembly 22 may be rotated during a drilling operation by a suitable rotational device. Other drilling systems may be used, and applications of the drilling assembly 22 are not limited to coiled tubing drilling. The unique drilling assembly described herein may be combined with a variety of mud motor designs and other motor designs intended for rotary drilling.

In the embodiment illustrated in FIG. 1, the power section 26 and bearing housing 32 have a common longitudinal axis 42. The longitudinal axis 42 is the axis that extends generally along a radial center of the bearing housing 32 and the power section 26. If, for example, the bearing housing 32 has a generally cylindrical outer surface then the cylindrical outer surface is concentric about the longitudinal axis 42. In this particular example, an outer surface 44 of the bearing housing 32 is generally cylindrical and also concentric about the longitudinal axis 42 as is an outer surface 46 of power section 26. Accordingly, the power section 26 and the bearing housing 32 are linearly aligned without a bent housing, e.g. without a bent motor housing. The internal bore 34, and thus the drill bit shaft 28, has a longitudinal bore/shaft axis 48 that forms a non-zero angle 50 with the longitudinal axis 42. The non-zero angle 50 is offset or non-linear with respect to the longitudinal axis 42. The non-zero angle 50 also may be referred to as the bend angle and establishes a much shorter bit-to-bend length 52 relative to conventional drilling systems using a bent housing. The non-zero angle 50 may be greater than 0.1 degree, such as 0.1-0.5 degree; however the non-zero angle 50 may be in a range of greater than 0.5 degree. Depending on the drilling application and the drilling assembly 22, the non-zero angle 50 may be within a selected, desired range, such as 0.1-0.5 degrees, 0.5-1.5 degrees, or 1.5-5.0 degrees. In some embodiments, non-zero angles greater than 5 degrees may be used when the drilling assembly component arrangement and size permits such larger angles.

The design of drilling assembly 22 enables use of a regular motor drive shaft and power section 26 for engagement with the drill bit shaft 28 and bearing housing 32. The angled orientation of internal bore 34 and drill bit shaft 28 causes the drill bit 30 to point at a desired angle with respect to the power section 26 and bearing housing 32, i.e. at a desired angle with respect to longitudinal axis 42 of power section 26 and bearing housing 32. This configuration achieves the shorter bit-to-bend distance, enables a straight power section and bearing housing, and improves steerability of the drilling assembly 22. Furthermore, conventional U-joint transmission designs can be used in power section 26.

Figure 2:
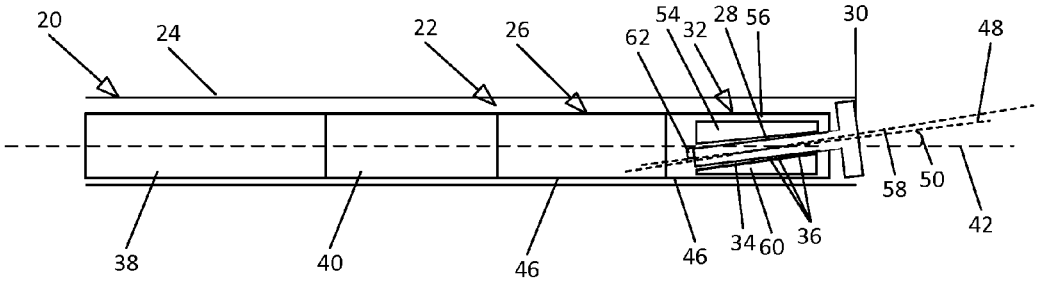
FIG. 2 is a schematic illustration of another example of a drilling assembly positioned in a wellbore and having a bearing housing, according to an alternate embodiment of the present disclosure.
Figure 3:
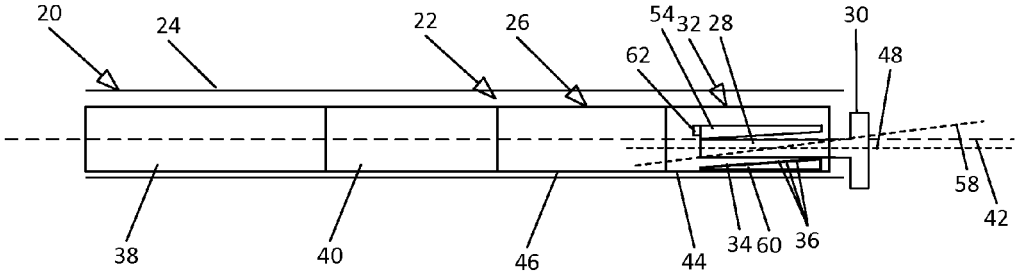
FIG. 3 is an illustration similar to that of FIG. 2 but showing the bearing housing actuated to orient the drill bit and drill bit shaft in a different direction, according to another embodiment of the present disclosure.

Referring generally to FIGS. 2 and 3, an alternate embodiment of the drilling assembly 22 is illustrated. In this embodiment, the bearing housing 32 comprises an internal sleeve 54 through which the internal bore 34 extends. The internal sleeve 54 is positioned within a radially outer portion 56 of bearing housing 32. The internal sleeve 54 has a longitudinal sleeve axis 58 along a radial centerline that, in this example, forms a non-zero angle with longitudinal axis 42 of bearing housing 32, i.e. the internal sleeve 54 is offset with respect bearing housing 32. In one example, the internal sleeve 54 is generally cylindrical in shape and has an outer sleeve surface 60 that is generally concentric about sleeve axis 58.

As illustrated in FIG. 2, however, the internal bore 34 is formed through the internal sleeve 54 at an offset angle, i.e. a non-zero angle with respect to the longitudinal sleeve axis 58. When the internal sleeve 54 is positioned within radially outer portion 56, the axis 48 of internal bore 34 and of drill bit shaft 28 may again be oriented to form the non-zero bend angle 50 between bore/shaft axis 48 and longitudinal axis 42. In some embodiments, the internal sleeve 54 is movable in a manner which enables the bend angle 50 to be changed. For example, the sleeve 54 may be pivotably mounted or rotatably mounted within the surrounding radially outer portion 56 of bearing housing 32. The latter embodiment allows the sleeve 54 to be rotated with respect to the radially outer portion 56 that, in turn, changes the angle 50 between longitudinal axis 42 and longitudinal bore axis 48, as illustrated in FIG. 3. It should be noted that in the embodiment illustrated, the non-zero angle 50 between longitudinal axis 42 and longitudinal bore axis 48 is different than the non-zero angle between longitudinal axis 42 and sleeve axis 58.

In the rotational sleeve embodiment, the sleeve 54 is shaped in such way that rotation of the sleeve 54 modifies the direction in which the drill bit shaft 28 and the drill bit 30 are pointing. Rotation of the internal sleeve 54 within radially outer portion 56 changes bend angle 50 and transitions the bit orientation between a maximum position, as illustrated in FIG. 2, and a straight position, as illustrated in FIG. 3. The maximum position is when the drill bit shaft 28 and the drill bit 30 are positioned at their maximum achievable angle 50 with respect to the power section 26, bearing housing 32 and longitudinal axis 42. The straight position occurs when sleeve 54 has been rotated to a position where the drill bit shaft 28 and the drill bit 30 are pointing straight ahead for drilling a well path in line with power section 26, bearing housing 32, and the longitudinal axis 42.

A rotation mechanism 62 may be mounted within power section 26 or bearing housing 32 to enable movement, e.g. rotation, of the internal sleeve 54. This allows the direction of drilling to be adjusted during a drilling operation to enable transition between well paths while drilling, e.g. transitioning from drilling straight wellbore sections to deviated wellbore sections. The rotation mechanism 62 may be constructed in a variety of forms and with a variety of hardware components controllable from, for example, a surface location or a downhole component. For example, the rotation mechanism 62 may comprise a variety of hydraulic actuators, motors, or other mechanisms.

Generally, the well system 20 may be constructed with several types of equipment components, including various configurations of the bottom hole assembly/drilling assembly. The power section 26 and its associated transmission, universal joints, and other components may vary substantially depending on the specifics of a given drilling application. Similarly, the size and configuration of the drill bit shaft 28, the drill bit 30, the internal bore 34, and/or the internal sleeve 54 may be adjusted to accommodate drilling and environmental parameters. Additional and/or alternate components may be utilized as desired to achieve drilling capabilities in selected drilling environments. In some applications, the straight housing sections illustrated above may be altered with a bent housing used in combination with the offset internal bore and drill bit shaft and/or with the internal sleeve 54 having a bore with a non-zero angle. A variety of internal components and materials also may be incorporated into the overall well system design.

In one embodiment, a drilling assembly for drilling a deviated wellbore is disclosed, the assembly comprising a bearing housing having an internal bore, wherein the bearing housing has a longitudinal axis, a bit shaft rotatably received in the internal bore and a drill bit coupled to the bit shaft for forming the deviated wellbore, wherein the internal bore has a longitudinal bore axis having a non-zero angle with respect to the longitudinal axis of the bearing housing.

In another embodiment, the drilling assembly further comprises a power section configured to power the bit shaft, wherein the longitudinal axis is common to both the power section and the bearing housing.

In another embodiment, the bearing housing has an internal sleeve through which the internal bore extends, the internal sleeve being positioned within a radially outer portion of the bearing housing.

In another embodiment, the internal sleeve is movable in a manner which changes the non-zero angle.

In another embodiment, the internal sleeve is rotatable with respect to the radially outer portion in a manner which changes the non-zero angle.

In another embodiment, the drilling assembly further comprises an actuator coupled to the internal sleeve to selectively rotate the internal sleeve with respect to the radially outer portion.

A drilling assembly for drilling a wellbore is disclosed, comprising a bearing housing having an outer surface generally concentric about a longitudinal axis, the bearing housing further comprising an internal bore sized to receive a drill bit shaft, the internal bore enabling the drill bit shaft to be positioned in a non-linear orientation in which a longitudinal axis of the drill bit shaft forms a non-zero angle with the longitudinal axis of the bearing housing.

In another embodiment, the drilling assembly further comprises a power section coupled to the bearing housing; and the bit shaft rotatably received in the internal bore, the bit shaft being connected to a drill bit used to drill the wellbore.

In another embodiment, the drilling assembly is accomplished wherein the non-zero angle is at least 0.1 degree.

In another embodiment, the drilling assembly is accomplished wherein the non-zero angle is at least 0.5 degree.

In another embodiment, the bearing housing comprises a sleeve received within a radially outer portion of the bearing housing, the sleeve having the internal bore.

In another embodiment, the sleeve has a longitudinal sleeve axis co-linear with the longitudinal axis of the bearing housing, the axis of the internal bore forming the non-zero angle with the longitudinal sleeve axis.

In another embodiment, the drilling assembly has a sleeve that is movable to change the non-zero angle.

In another embodiment, the drilling assembly further comprises an actuator coupled to the sleeve to rotate the sleeve relative to the radially outer portion.

In another embodiment, a method to facilitate drilling of a wellbore, is performed, comprising combining a power section with a bearing housing to form a drilling assembly and rotatably mounting a drill bit shaft in the bearing housing at an offset orientation such that a longitudinal shaft axis of the drill bit shaft forms a non-zero angle with a longitudinal axis of the bearing housing to enable drilling of a deviated section of a wellbore.

In another embodiment the method is accomplished wherein the rotatably mounting comprises rotatably mounting the drill bit shaft in an internal bore of a sleeve received in the bearing housing.

In another embodiment the method is accomplished wherein the rotatably mounting comprises rotatably mounting the drill bit shaft in an internal bore of a sleeve rotatably received in the bearing housing.

In another embodiment the method further comprises rotating a drill bit with the drill bit shaft to thereby drill the wellbore.

In another embodiment the method further comprises changing the non-zero angle during the drilling operation.

In another embodiment the method is accomplished wherein the changing comprises changing the non-zero angle to a zero angle for drilling a straight section of the wellbore.

Although only a few embodiments of the present disclosure have been described in detail above, those of ordinary skill in the art will readily appreciate that many modifications are possible without materially departing from the teachings of this invention. Accordingly, such modifications are intended to be included within the scope of this disclosure as defined in the claims.

What is claimed is:

1. A drilling assembly for drilling a deviated wellbore, comprising:

a bearing housing having an internal bore, wherein the bearing housing has a longitudinal axis and an internal sleeve through which the internal bore extends, the internal sleeve being positioned within a radially outer portion of the bearing housing;

a bit shaft rotatably received in the internal bore; and a drill bit coupled to the bit shaft for forming the deviated wellbore, wherein the internal bore has a longitudinal bore axis having a first non-zero angle with respect to the longitudinal axis of the bearing housing, and wherein the internal sleeve has a longitudinal sleeve axis having a second non-zero angle with respect to the longitudinal axis of the bearing housing, and the first and second non-zero angles are different.

2. The drilling assembly according to claim 1, further comprising:

a power section configured to power the bit shaft, wherein the longitudinal axis is common to both the power section and the bearing housing.

3. The drilling assembly according to claim 1, wherein the internal sleeve is movable in a manner which changes the first non-zero angle.

4. The drilling assembly according to claim 1, wherein the internal sleeve is rotatable with respect to the radially outer portion in a manner which changes the first non-zero angle.

5. The drilling assembly according to claim 4, further comprising:

an actuator coupled to the internal sleeve to selectively rotate the internal sleeve with respect to the radially outer portion.

6. The drilling assembly according to claim 1, wherein the sleeve is movable to change the non-zero angle.

7. The drilling assembly according to claim 6, further comprising:

an actuator coupled to the sleeve to rotate the sleeve relative to the radially outer portion.

8. The drilling assembly of claim 1, wherein the bit shaft is substantially disposed within the internal bore.

9. The drilling assembly of claim 1, wherein the internal bore receives a majority of the length of the bit shaft.

10. A drilling assembly for drilling a wellbore, comprising:

a bearing housing having an outer surface generally concentric about a longitudinal axis, the bearing housing further comprising a sleeve received within a radially outer portion of the bearing housing, the sleeve having a longitudinal sleeve axis and an internal bore sized to receive a drill bit shaft, the internal bore enabling the drill bit shaft to be positioned in a non-linear orientation in which a longitudinal axis of the drill bit shaft forms a non-zero angle with the longitudinal axis of the bearing housing, wherein another non-zero angle formed between the longitudinal axis of bearing housing and a longitudinal sleeve axis is different from the non-zero angle between the longitudinal axis of the drill bit shaft and the longitudinal axis of the bearing housing.

11. The drilling assembly according to claim 10, further comprising:

a power section coupled to the bearing housing; and the bit shaft rotatably received in the internal bore, the bit shaft being connected to a drill bit used to drill the wellbore.

12. The drilling assembly according to claim 11, wherein the non-zero angle is at least 0.1 degree.

13. The drilling assembly according to claim 11, wherein the non-zero angle is at least 0.5 degree.

14. The drilling assembly of claim 10, wherein the drill bit shaft is mounted within the internal bore by a combination of axial and radial bearings.

15. The drilling assembly of claim 10, wherein a majority of the length of the drill bit shaft is received in the internal bore of the sleeve.

16. A method to facilitate drilling of a wellbore, comprising:

combining a power section with a bearing housing to form a drilling assembly; and rotatably mounting a drill bit shaft in an internal bore of a sleeve received in the bearing housing at an offset orientation such that a longitudinal shaft axis of the drill bit shaft forms a first non-zero angle with a longitudinal axis of the bearing housing to enable drilling of a deviated section of a wellbore, and a longitudinal sleeve axis of the sleeve forms a second non-zero angle with the longitudinal axis of the bearing house, the first and second non-zero angles being unequal.

17. The method according to claim 16, wherein the sleeve is rotatably received in the bearing housing.

18. The method according to claim 16, further comprising:

rotating a drill bit with the drill bit shaft to thereby drill the wellbore.

19. The method of claim 18, further comprising:

changing the first non-zero angle during the drilling operation.

20. The method of claim 19, wherein the changing comprises changing the first non-zero angle to a zero angle for drilling a straight section of the wellbore.

* * * * *